US005304403A

United States Patent [19]

Schlesinger et al.

[11] Patent Number: 5,304,403

[45] Date of Patent: Apr. 19, 1994

[54] ZINC/NICKEL/PHOSPHORUS COATINGS AND ELECROLESS COATING METHOD THEREFOR

[75] Inventors: Mordechay Schlesinger, Windsor, Canada; Dexter D. Snyder, Birmingham, Mich.

[73] Assignee: General Motors Corporation, Detroit, Mich.

[21] Appl. No.: 941,277

[22] Filed: Sep. 4, 1992

[51] Int. Cl.[5] ..... C23C 26/00

[52] U.S. Cl. ..... 427/437; 427/304; 427/305; 427/438; 427/443.1

[58] Field of Search ..... 427/304, 306, 437, 443.1, 427/438, 305

[56] References Cited

U.S. PATENT DOCUMENTS

| | | | |
|---|---|---|---|
| 4,125,646 | 11/1978 | Dean | 427/405 |
| 4,128,691 | 12/1978 | Shirahata | 427/129 |
| 4,250,225 | 2/1981 | Shirahata | 427/129 |
| 4,758,479 | 7/1988 | Swathirajan et al. | 428/659 |

FOREIGN PATENT DOCUMENTS

| | | | |
|---|---|---|---|
| 2747001 | 4/1978 | Fed. Rep. of Germany . | |
| 164067 | 12/1980 | Japan | 427/443.1 |
| 136965 | 10/1981 | Japan | 427/437 |
| 57-12592 | 1/1982 | Japan . | |
| 141882 | 7/1985 | Japan | 427/437 |
| 62-274076 | 11/1987 | Japan . | |

OTHER PUBLICATIONS

J. P. Marton et al, J. Electrochem Soc., vol. 115, No. 1 (1968).

S. L. Chow et al, J. Electrochem. Soc., vol. 119, No. 12 (1972).

M. Kurachi et al, Proc. Cong. Int. Union Electrodeposition Surf. Tech. N. Ibl, Ed., 1522 (1973).

L. G. Svendsen et al, J. Electrochem Soc., vol. 130, No. 11 (1983).

R. O. Cortijo et al, J. Electrochem Soc., vol. 130, No. 12 (1983).

M. Schlesinger et al, J. Electrochem. Soc., vol. 36, No. 6 (1989).

M. Schlesinger et al, J. Electrochem. Soc; vol. 37, No. 6 (1990).

M. Schlesinger et al, J. Electrochem Soc; vol. 138, No. 2 (1991).

Konrad Parker, Electroless Nickel: State of the Art, Mar. 1992.

Abstracts from 1991 American Chemical Society database for German Pat. No. 2747001 and Japanese Patent Nos. 57-12592 and 62-274076.

*Primary Examiner*—Shrive Beck

*Assistant Examiner*—Vi Duong Dang

*Attorney, Agent, or Firm*—Lawrence B. Plant

[57] ABSTRACT

In a preferred method, a zinc-rich alloy coating is applied to a substrate using an electrolysis deposition solution which contains a metal salt of zinc and a metal salt of nickel each in an amount sufficient to provide a weight ratio of zinc to nickel (Zn:Ni) of at least about 1:1; a phosphorus-containing reducing agent in an amount sufficient to cause reduction of the zinc and the nickel to ions thereof; sufficient complexing agent to maintain the nickel ions and the zinc ions in solution; and a buffer in an amount sufficient to achieve a desired pH. Preferably, the surface of the substrate is pretreated or precatalyzed before deposition by a sensitizing step using tin and an activating step using palladium.

16 Claims, No Drawings

ZINC/NICKEL/PHOSPHORUS COATINGS AND ELECROLESS COATING METHOD THEREFOR

FIELD OF THE INVENTION

This invention relates to zinc-based coatings and an electroless method of depositing such coatings.

BACKGROUND OF THE INVENTION

Coatings of metal have been applied to a variety of substrates for many years. Such coatings are often used to provide corrosion resistance, and recently to achieve magnetic effects. A particularly effective corrosion resistant coating includes zinc. Automobile exterior body parts, namely, fenders, door panels, and the like are among the most difficult parts to protect from corrosion because of the environment to which they are exposed and their susceptibility to surface damage tending to create corrosion sites.

Currently, automobiles and trucks are protected from corrosion by a zinc or zinc alloy layer coated on the steel before vehicle fabrication. Since the zinc rich metal coating protects steel sacrificially at damage sites in the paint, the corrosion resistance in the vehicle is increased dramatically. There is, however, a drawback in that the metallic zinc or zinc alloy must be applied to the steel prior to manufacturing of the vehicle. Hence, operations such as blanking, welding, and painting occur after a zinc coating has been applied to the steel. Welding tip life is significantly reduced in the presence of zinc coatings and various forming operations are hindered by zinc accumulating in dies. A zinc-based coating is not applied after vehicle assembly because there is no suitable method to apply it. For example, electro-deposition of a zinc coating onto completed, assembled parts does not provide coverage to convoluted parts and recesses in parts. Electro-deposition is simply not able to provide a uniform metal coating on complex shapes and in cavities. It would be desirable to obtain a protective corrosion resistant coating which is easy to apply to surfaces of objects regardless of their configuration, which provides an essentially uniform coating on the surfaces, which may be applied after assembly of componentry, and which is compatible with subsequent operations such as painting.

SUMMARY OF THE INVENTION

There is provided an electroless method of making a zinc-rich alloy coating which includes first forming a deposition solution comprising: a metal salt of zinc and a metal salt of nickel each in an amount sufficient to provide a weight ratio of zinc to nickel (Zn:Ni) of at least about 1:1; a phosphorus-containing reducing agent in an amount sufficient to cause reduction of the zinc and the nickel to ions thereof; sufficient complexing agent to maintain the nickel ions and the zinc ions in solution; and a buffer in an amount sufficient to achieve a basic pH. Next, the deposition solution is applied to a substrate for a time and at a temperature and in an amount sufficient to form a solid admixture containing zinc, nickel, a minor but effective amount of phosphorus and optionally tin and palladium.

Desirably, each liter of the deposition solution comprises about 10 to about 30 grams of the zinc salt and about 1 to about 30 grams of the nickel salt. Preferably, the amount of zinc salt is sufficient to provide a weight ratio of zinc to nickel of at least about 20:1. Preferably, the complexing agent is sodium citrate, the buffer is ammonium chloride and the reducing agent is sodium hypophosphite. The buffer provides a pH of at least about 12, desirably 12.0 to 12.5, and preferably 12.2 to 12.5.

Preferably, the surface of the substrate is pretreated or precatalyzed before deposition by a sensitizing step using tin and an activating step using palladium. In the sensitizing step, a solution is applied which comprises a metal salt of tin (Sn) in an amount sufficient to deposit ionic tin at dispersed sites on a surface of the substrate. The ionic tin comprises $Sn^{+2}$ and $Sn^{+4}$ (Sn IV). Preferably, excess tin is then removed.

Next, in the activating step, a solution is applied which comprises a metal salt of palladium in an amount sufficient to provide palladium at the tin deposition sites. Preferably, excess palladium is then removed.

Where the substrate is a nonconductor, the precatalysis steps are usually required to achieve acceptable results. Precatalysis is optional, but preferred, for other substrates. The sensitizer solution is preferably prepared with $Sn^{+4}$, constituting about 20 atomic percent of the total tin in solution. This solution is preferably obtained by adding tin chloride ($SnCl_2$) dissolved in concentrated HCl to distilled water in an amount sufficient to provide about 3 grams $SnCl_2$ per liter of solution and then maintaining the solution at about room temperature for at least about 24 hours.

In another embodiment, the precatalysis steps are used in combination with electroless deposition using an acidic deposition solution. The reducing agent of the acidic deposition solution is a mixture of sodium hypophosphite and sodium thiophosphate. The acidic deposition solution is preferably at a temperature of about 70° C. to about 80° C. when deposition begins and is cooled at a rate of about 1° C. to about 2° C. per minute.

Objects, features, advantages of the invention are to provide a protective corrosion resistant coating which is easy to apply to surfaces of objects regardless of their configuration, which provides an essentially uniform coating on the surfaces, which may be applied after assembly of componentry, and which is compatible with subsequent operations such as painting.

These and other objects, features and advantages will become apparent from the following description of the preferred embodiments and appended claims.

DETAILED DESCRIPTION OF THE PREFERRED EMBODIMENTS

In the method of the invention, an electroless chemical deposition process applies a metallic zinc alloy uniformly to a substrate including any recesses and convolutions thereof. The electroless deposition bath (solution) combines metal ions and a soluble reducing agent at a catalytic surface of the substrate to produce the metallic layer. The electroless deposition method of the invention provides reduction of metal at surfaces of the substrate to provide the admixture. The layer is an admixture of zinc, nickel, and phosphorus. The layer is corrosion resistant and is also useful to provide certain magnetic effects. Zinc added to a nickel film increases the maximum coercivity by up to 50%, increases magnetic squareness and produces a superior magnetic recording medium.

A complexer is included in the deposition bath to maintain the metal in solution in order to facilitate deposition. Citrate and succinate are two desirable complexers. Other complexers may be used so long as they maintain metal in solution for deposition while not interfering with reduction of the metal. The bath may include conductivity enhancers such as soluble ammonium salts. A preferred reducing agent is sodium hypophosphite or a mixture of sodium hypophosphite and sodium thiophosphate.

Some materials require precatalysis prior to deposition in order to facilitate deposition of the layer. These materials include ceramics and glasses. Other substrate surfaces are autocatalytic to deposition and do not require precatalysis; such materials include steel.

The precatalysis steps which initiate deposition for nonconductors such as glass and ceramic include a two-step process of tin sensitization and palladium (activation) catalyzation. In this process, the substrate to be coated is dipped first in a solution of tin chloride to form nanometer scale islands of tin chloride and tin oxide deposits on the substrate. These islands become sites for the ultimate growth of the electroless deposit. After sensitization, the film is rinsed and immersed in a palladium solution where metal clusters deposit on the tin islands. The surface is again rinsed and then placed in the metallizing electroless deposition bath.

In the metal bath, the tin islands (deposition sites) provide sites from which growth of metal film (admixture) occurs until the film becomes continuous from site to site, the deposition essentially then occurs autocatalytically. More specifically, the tin colloid is deposited initially as islands of a few nanometer dimension, and the palladium metal is deposited on the tin as 1-nanometer scale nucleation centers. The zinc-nickel grows radially from these scattered centers, eventually coalescing to a continuous layer or film. The Sn/Pd centers are buried in the deposited layer, but as scattered regions and not as a continuous layer. Hence, the scattered nucleation centers (sites) have little influence on the bonding of the alloy to the substrate.

The sensitization and catalyzation process (precatalysis) is preferably conducted once to initiate uniform coverage on steel and is conducted preferably twice to coat nonconductors. Although a layer is formed on steel without precatalysis, better results are achieved by using one cycle of precatalysis.

The formation of the sensitizer and activator solutions will now be described, followed by a description of the electroless metallizing solutions and the sequence of steps by which metallizing is accomplished, with and without precatalysis.

I. Sensitizer Solution

The tin sensitization step, to some degree, controls the quality of the deposited admixture of zinc, nickel, and phosphorus. Best results are found when the initial tin colloidal layer produced during the tin sensitization step is controlled so that the colloidal size obtained is in the range of a few nanometers in diameter. Tin colloids grown to a larger size are not well adhered to the substrate. The size of the tin colloids is controlled by essentially aging the tin solution. A preferred tin sensitizer solution is formed by adding about 10 grams of $SnCl_2$ to about 10 ml of concentrated hydrochloric acid. This forms a stock solution of 10 grams $SnCl_2$ in $H_2O$ in 10 ml concentrated HCl. Then, 1 ml of the tin chloride stock solution was added to 100 ml of deionized water and permitted to age essentially at room temperature for between about 24 and about 48 hours. It was determined that the aging step was complete when ionic tin in the plus four state ($Sn^{+4}$) in the aged solution constituted about 20 atomic percent of the ionic tin. This typically occurred within the 24 to 48 hour period. It has been found that over-aging the sensitizer gives overly large colloids which can be broken down by sonification, for example, to rejuvenate the solution. The conditions of time and concentration for preparing and aging the tin sensitizer solution can vary, for example, about 0.1 to about 10 ml of stock solution may be added to 200 ml of water.

II. Activator Solution

The stock catalyzation (palladium, Pd) solution was made of about 10 grams $PdCl_2$ in about 10 ml concentrated HCl. The palladium chloride activator solution was prepared by adding about 0.1 ml of a stock $PdCl_2$ solution to 100 ml of deionized water. The activator solution can vary, for example, from about 0.1 to about 10 ml of stock ($PdCl_2$) added to 200 ml water.

III. Solution for Electroless Deposition

Each liter of deposition solution contained about 1 to about 30 grams nickel sulfate and about 1 to about 30 grams zinc sulfate, plus complexer, reducing agent, and buffer to adjust pH. Alkaline and acidic deposition solutions were prepared with alkaline being preferred. It should be noted that the atomic weights of zinc and nickel are similar and the molecular weights of their sulfates are also similar. The atomic weights of zinc and nickel are, respectively, 65 and 59 The molecular weights of zinc sulfate and nickel sulfate are, respectively, 161 and 155. Conveniently, the weight ratio of the sulfate roughly corresponds to the weight ratios of the zinc and nickel in the final alloy product.

A. Alkaline Solution

The alkaline deposition solution (metallizer) constituted: nickel sulfate ($NiSO_4.6H_2O$) about 1 to about 30 grams per liter (0.0038M to 0.11M), zinc sulfate ($ZnSO_4.7H_2O$) about 1 to about 30 grams per liter (0.0035M to 0.104M), sodium hypophosphite 10.6 grams per liter, ±2 grams per liter (0.1M), sodium citrate 200 grams per liter, ±40 grams per liter (0.68M), and ammonium chloride 53.6 grams per liter, ±10 grams per liter (1M). It should be noted that approximately ±20% variation in the specified amounts does not change results significantly. In the alkaline depositions, before metallizing the pH was adjusted to the desired basic value with concentrated sodium hydroxide.

B. Acidic Solution

Prepared as per Example 3.

IV. Metallization Process

The sensitizer was aged for about 24 hours as described in Part I. The activator was prepared as described in Part II. The metallizing bath was prepared with the desired nickel and zinc ratio of the metal salts as in Part III with the desired pH and brought to a desired temperature. The prepared substrate was immersed in sensitizer for one minute, then rinsed for about 30 seconds. Next, the substrate was activated in the palladium bath (activator), then rinse for about 30 seconds. Then the substrate was immersed in the deposition (metallizing) bath. In a variation on this basic process, the sensitizer and activator emersion steps were repeated before metallizing to give two sensitization-/activation (precatalysis) treatments before metallizing.

In another variation, some cleaned steel substrates were metallized without the precatalysis steps of sensitization and activation.

EXAMPLE 1

Zinc alloy coatings were applied to glass and polyvinyl formal ("Formvar") substrates. The sensitizer was made from 10 grams $SnCl_2$ in 10 ml concentrated hydrochloric acid, and by adding 1 ml stock $SnCl_2$ solution to 100 ml deionized water; then aging. The activator was prepared by adding 10 grams $PdCl_2$ in 10 ml concentrated hydrochloric acid, and by adding 0.1 ml stock $PdCl_2$ solution to 100 ml deionized water.(i.e. 0.1 grams PdC12 per 100 ml water).

The metallizing solution contained 200 grams per liter sodium citrate, 54 grams per liter ammonium chloride, 11 grams per liter sodium hypophosphite, 1 gram per liter nickel sulfate ($NiSO_4.6H_2O$), 30 grams per liter zinc sulfate ($ZnSO_4.7H_2O$).

The basic metallizing process included first immersing the substrate for about 1 minute in sensitizer, and then immersing for about 30 seconds DI water dip rinse to remove excess tin. Next, immersing the substrate for about 1 minute in activator, and then immersing for about 30 seconds DI water dip rinse. Next, repeating the sensitizer/rinse/activator/rinse sequence; and then immersing in the metallizing solution at a temperature of about 20° C. to about 60° C.

The amount of ammonium chloride was varied to vary pH in the basic range (i.e. pH greater than 7) up to about pH of 13.

The deposits at pH in excess of about 12.3 showed extremely high zinc and negligible phosphorus content in the alloys most of the time (Table 1). It is assumed that the scatter in the results, as well as the occasional low zinc values, underline the sensitivity of the alloy composition to the pH. Initial deposits of zinc-nickel were done at room temperature, but a better deposition rate and higher zinc content is achieved at about 50° C. The preferred weight-ratio of zinc to nickel salts in the solution was in the range of about 20:1 to about 30:1. Samples of high zinc were not routinely achieved with about 10:1, but they were achieved with both 20:1 and 30:1 ratios. The minimum ratio appeared to be about 20:1 and the maximum is determined by the maximum solubility for the zinc salt and/or the minimum nickel concentration required to give deposition.

Table 2 shows the variation of zinc content with pH in the electroless deposit method. The zinc content in the range of basic pH increased as pH increased. At a pH in excess of about 12, the zinc content of the admixture (layer) reached 68 atomic percent (a/0). The depositions of Table 2 were done at constant temperature of about 40° C. to about 60° C. While there is moderate scatter, deposits having 70 a/0 zinc and up are repeatedly achieved. The deposits were very low in phosphorus which indicates microcrystalline, rather than the amorphous deposits. There was no evidence that temperature has a dramatic effect on the individual zinc and nickel deposition rates from the alkaline solution. It appeared that nickel sulfate should be at least 1 gram per liter. Below this level, deposition did not occur. Elemental phosphorus is produced by a chemical reaction at a rate determined by the amount of hydrogen ion in solution. At the high pH values in this process, hydrogen ion concentration is extremely low and the rate of phosphorus production is slow. Hence, little phosphorus is included in these electroless alloys deposited at a pH greater than about 13. It appears that phosphorus can be absent from the deposit, i.e. it has no known catalytic effect, and it is not essential for the corrosion protection function. However, due to the chemistry of the process, some phosphorus will always be present even if in minute quantity.

TABLE 1

Zinc-Nickel Deposits Prepared with Basic Deposition Solution at 50° C.

| pH | $NiSO_4.6H_2O$ (grams/liter) | $ZnSO_4.7H_2O$ (grams/liter) | Alloy Composition (a/0) Zinc | Nickel | Phosphorus |
|---|---|---|---|---|---|
| 12.5 | 10 | 10 | 28 | 71 | 1 |
| 12.5 | 5 | 10 | 29 | 68 | 2 |
| 12.5 | 1 | 10 | 39 | 57 | 4 |
| 12.2 | 1 | 20 | 98 | 2 | <1 |
| 12.2 | 1 | 20 | 86 | 13 | <1 |
| 12.2 | 1 | 20 | 82 | 16 | 2 |
| 12.5 | 1 | 30 | 79 | 21 | <1 |
| 12.2 | 1 | 30 | 70 | 30 | <1 |
| 12.2 | 1 | 30 | 66 | 34 | <1 |

TABLE 2 pH Influence on Amount of Zinc/Nickel/Phosphorus Deposited at 50° C., 1 gram per liter $NiSO_4.6H_2O$ and 30 grams per liter $ZnSO_4.7H_2O$ (Atomic Percentages)

| pH | Zinc | Nickel | Phosphorus |
|---|---|---|---|
| 9 | 8 | 79 | 13 |
| 10 | 11 | 77 | 12 |
| 11 | 10 | 82 | 8 |
| 12.5 | 68 | 27 | 4 |

It should be noted that the system does not function for zinc alone. The nickel must be reduced to provide sites for the subsequent zinc and nickel reduction and growth as an admixture similar to an alloy.

One key feature for the plating of this admixture onto nonconductors is the need for a tin sensitizer which is aged. The aging time is preferably about 48 hours and one week would be the approximate maximum. As stated earlier, this aging permits the colloids of tin to grow to a preferred size which favors the acceptance of the palladium catalyst and subsequent growth of a deposited layer of high integrity. The double precatalysis pretreatment for dielectric accepting high zinc deposits from the alkaline baths, appeared to relate to the form of palladium in solution. It appeared that the return of the palladium bearing substrate to the tin solution resulted in more activation and more uniform coverage over the substrate.

EXAMPLE 2

Four sets of steel samples were prepared with 50% hydrochloric acid etch; and two of the four sets were given the tin-palladium precatalysis treatment described above. Two of the four sets were not precatalyzed. All four sets were metallized with the alkaline bath using a zinc sulfate-to-nickel sulfate weight ratio of 30:1, and a plating temperature of about 22° C. (room temperature). One set prepared with the tin-palladium catalyzed surface at pH 12.0 gave a relatively thin alloy with zinc in the 30% range and nickel in the 60% to 70% range. Another set prepared with a noncatalyzed surface at pH 12.0 gave a thin, spotty alloy with 87 atomic percent zinc, 11 atomic percent nickel, and 2 atomic percent phosphorus. A third set prepared with a noncatalyzed surface at pH up to about 12.6 gave a deposit too thin to be characterized by x-ray fluorescence spectroscopy.

Best results were obtained from the alloy deposited on HCl-etched steel which had been precatalyzed (tin-palladium catalyzed), using deposition on pH's in the range 12.2–12.6. Compositions for the six different depositions onto HCl-etched, precatalyzed steel substrates are shown in Table 3.

TABLE 3

ALLOY COMPOSITION WITH PRECATALYSIS

| Sample | pH of Deposition | Zinc (a/0) | Nickel (a/0) | Phosphorus (a/0) |
|---|---|---|---|---|
| 1 | 12.2 | 82 | 15 | 3 |
| 2 | 12.2 | 95 | 4 | 1 |
| 3 | 12.4 | 92 | 7 | 1 |
| 4 | 12.4 | 60 | 33 | 6 |
| 5 | 12.6 | 82 | 15 | 3 |
| 6 | 12.6 | 99 | 1 | 0 |

Although there appeared to be an advantage to tin-palladium catalysis (precatalysis), high zinc alloy was deposited onto uncatalyzed steel. (Example 2.) Advantageously, a high zinc alloy was deposited onto a non-conducting surface using the two-step tin-palladium pretreatment. (Example 1.)

The coated substrates of Examples 1 and 2 were analyzed to measure the admixture (alloy coating) composition using x-ray fluorescence spectroscopy, calibrated by dissolving the coating from selected samples and recording the metal concentrations in solution. From such analysis, several key factors emerged. Zinc content in excess of 90 atomic percent can be reached in alloy (admixture) deposited on steel with either no activation, or with the two-step tin-palladium activation. The alloy (admixture) deposited on a tin-palladium catalyzed (precatalyzed) steel surface is much thicker and more uniform than on a non-precatalyzed surface when an alkaline metallizing bath is used, a pH equal to or exceeding about 12, preferably in the range of 12–13 and desirably greater than about 12.2, achieves the high zinc content.

The x-ray diffraction patterns of the high zinc deposits of Examples 1 and 2 suggested that the deposited layer is an alloy with separate phases, probably metastable. This suggests optimum corrosion protection, because zinc is as a separate phase freely accessible to dissolve as it protects, sacrificially, the steel on which it is deposited. The intimate microstructure with the extremely small scale also would help to keep nickel-rich areas from growing to such a size that they would become cathodic sites to drive anodic dissolution of the underlying steel at damage points. The existence of these apparently separate phases indicates the admixture is an alloy with separate phases, rather than a typical blended alloy.

EXAMPLE 3

In another application of the unique sensitizing and activation methods, zinc alloy coatings were formed by using the sensitizer of part I, the activator of part II, and an acidic metallizing method. The acidic method followed a deposition procedure similar to Example 1, except that the metallizing step was conducted with controlled cooling and an acidic, rather than alkaline, metallizing solution was used.

The acidic metallizing solution included nickel sulfate ($NiSO_4.6H_2O$) in amounts up to about 29 grams per liter (0.11M), sodium hypophosphite at up to about 17 grams per liter (0.16M), sodium succinate at about 15 grams per liter (0.06M), succinic acid at about 0.1 to 1.3 grams per liter (0.0035M to 0.011M) and a pH in the range of about 3 to about 7. Zinc was added as zinc sulfate ($ZnSO_4.7H_2O$) from about 1 to about 30 grams per liter (0.0035M to 0.104M) depending on the zinc/nickel salt weight-ratio and the absolute amount of zinc chosen. In addition, some sodium thiophosphate was added in the range of up to about 3 parts by weight of the thiophosphate for every 10 parts of sodium hypophosphite.

In the method of Example 3, a temperature ramp was used wherein the metallizing solution was initially heated to about 70° C. and then permitted to cool slowly at a fixed rate over approximately an hour as the deposition occurred. A cooling rate of about 1° C./minute to about 2° C./minute was found to be suitable.

The microstructures of Example 3 are characteristically amorphous which correlates with the high phosphorus content. The products of Examples 1 and 2 appear to be microcrystalline as the electron diffraction patterns are complex. Transmission electron microscope diffractograms showed that the high zinc deposits may be either a combination of face-centered cubic nickel and hexagonal close-packed zinc or they are amorphous.

Therefore, the deposited layer may not be an alloy in the usual sense, but may be a metastable admixture on the angstrom level of nickel and zinc.

While this invention has been described in terms of certain embodiments thereof, it is not intended that it be limited to the above description, but rather only to the extent set forth in the following claims.

The embodiments of the invention in which an exclusive property or privilege is claimed are defined in the appended claims.

We claim:

1. A method for electrolessly depositing a sacrificial, corrosion-protective zinc-based alloy coating onto a clean or chemically etched metal substrate, by the steps of:

a) forming a deposition solution comprising: i) a zinc salt and a nickel salt each in an amount sufficient to provide a weight ratio of zinc salt to nickel salt of at least about 10 to 1 ii) a phosphorus-containing reducing agent in an amount sufficient to cause reduction of said salts of the corresponding zinc and the nickel metals thereof, iii) sufficient complexing agent to maintain the nickel ions and the zinc ions in solution, and iv) a buffer in an amount sufficient to achieve a basic pH of at least about 12; and then b) contacting the substrate with sufficient deposition solution for a time and at a temperature sufficient to electrolessly deposit a solid coating containing at least about 60 atomic percent zinc, and also containing nickel, and phosphorus onto the substrate.

2. A method for electrolessly depositing a sacrificial, corrosion-protective zinc-based alloy coating onto a clean or chemically etched metal substrate, by the steps of:

a) sensitizing the substrate by contacting the substrate with a first solution comprising a tim salt in an amount sufficient to deposit ionic tin at dispersed sites on the substrate, the ionic tin comprising $Sn^{+4}$ (Sn IV);

b) activating the substrate by contacting the substrate with a second solution comprising palladium salt in an amount sufficient to provide palladium at said dispersed sites;

c) forming a deposition solution comprising: i) a zinc salt and a nickel salt each in an amount sufficient to provide a weight ratio of zinc salt to nickel salt of at least about 10 to 1, ii) a phosphorus-containing reducing agent in an amount sufficient to cause reduction of said salts to the corresponding zinc and the nickel metals thereof, iii) sufficient complexing agent to maintain the nickel ions and the zinc ions in solution, and iv) a buffer in an amount sufficient to achieve a basic pH of at least about 12; and then d) contacting the substrate with sufficient deposition solution for a time and at a temperature sufficient to electrolessly deposit a solid said coating containing at least about 60 atomic percent zinc, and also containing nickel, phosphorus, tin and palladium, onto the substrate.

3. The method according to claim 1, wherein each liter of the deposition solution comprises about 10 to about 30 grams of the zinc salt and about 1 gram of the nickel salt.

4. The method according to claim 1, wherein the complexing agent is sodium citrate, the buffer is ammonium chloride and the reducing agent is sodium hypophosphite.

5. The method according to claim 2, wherein the weight ratio is at least about 20 to 1 and the coating contains at least about 90 atomic percent zinc.

6. The method according to claim 2, wherein the pH is in a range of about 12.2 to about 12.6.

7. The method according to claim 2, wherein the zinc and nickel salts are each in an amount sufficient to provide a weight ratio in a range of about 10 to 1 to about 30 to 1.

8. The method according to claim 1, wherein each liter of the solution comprises about 30 grams of the zinc salt which is zinc sulfate, about 1 gram of the nickel salt which is nickel sulfate, about 200 grams of the complexing agent which is sodium citrate, about 54 grams of the buffer which is ammonium chloride, and about 11 grams of the reducing agent which is sodium hypophosphite.

9. The method according to claim 2, wherein the $Sn+4$ constitutes about 20 atomic percent of the ionic tin.

10. The method according to claim 1, wherein the temperature of step (b) is in the range of about 20° C. to about 50° C.

11. The method according to claim 2 and further including immediately after the step of sensitizing, removing any excess tin from the substrate.

12. The method according to claim 11 and further including after the step of activating, removing any excess palladium from the substrate.

13. The method according to claim 12, wherein the steps of sensitizing, removing excess tin, activating, and removing excess palladium are repeated in sequence before the step of contacting the substrate with the deposition solution.

14. The method according to claim 2, wherein the steps of sensitizing and activating are repeated in sequence prior to the step of contacting the substrate with the deposition solution.

15. The method according to claim 2 and further including before the step of sensitizing, forming the ionic tin by adding tin chloride ($SnCl_2$) dissolved in concentrated HCl to distilled water in an amount sufficient to provide about 3 grams $SnCl_2$ per liter of solution and then maintaining the solution at about room temperature for at least about 24 hours.

16. The method according to claim 1 wherein the pH is in a range of about 12.2 to about 12.6.

* * * * *